United States Patent [19]

Leider et al.

[11] 4,023,737

[45] May 17, 1977

[54] SPIRAL GROOVE PATTERN REFINER PLATES

[75] Inventors: Philip J. Leider, Columbia, Md.; Jorg Rihs, Hot Springs, Va.

[73] Assignee: Westvaco Corporation, New York, N.Y.

[22] Filed: Mar. 23, 1976

[21] Appl. No.: 669,684

[52] U.S. Cl. ..... 241/261.3; 241/298

[51] Int. Cl.[2] ..... B02C 7/12

[58] Field of Search ..... 241/261.2, 261.3, 296, 241/297, 298

[56] References Cited

UNITED STATES PATENTS

| | | | |
|---|---|---|---|
| 4,382 | 2/1846 | Snyder | 241/296 |
| 727,156 | 5/1903 | Lacey | 241/298 |
| 1,609,717 | 12/1926 | Letz | 241/261.3 |
| 2,356,753 | 8/1944 | Dotzer | 241/297 X |
| 2,912,174 | 11/1959 | Bidwell | 241/296 X |
| 3,674,217 | 7/1972 | Reinhall | 241/296 X |
| 3,910,511 | 10/1975 | Leider et al. | 241/298 X |

FOREIGN PATENTS OR APPLICATIONS

| | | | |
|---|---|---|---|
| 1,020,516 | 12/1957 | Germany | 241/296 |

*Primary Examiner*—Roy Lake
*Assistant Examiner*—Howard N. Goldberg
*Attorney, Agent, or Firm*—W. Allen Marcontell; Richard L. Schmalz

[57] ABSTRACT

The bar and channel pattern of a disc refiner plate follows the curve of a continuous circular arc from the stock distribution ring groove to the outer plate periphery. Each channel is of constant sectional flow area to provide uniform flow area into and out of the refiner section.

8 Claims, 4 Drawing Figures

SPIRAL GROOVE PATTERN REFINER PLATES

BACKGROUND OF THE INVENTION

1. Field of the Invention

The present invention relates to disc refining of wood pulp as a papermaking stock preparation process. More specifically, the present invention relates to the bar and channel pattern in the refiner section of a disc refiner plate.

2. Description of the Prior Art

In the preparation of wood pulp for papermaking, cellulosic fibers are subjected to a series of mechanical working or shearing operations prior to final web forming. The generally concluded objective of such mechanical stock working is to develop increased fibrillation of individual cellulose fibers which contribute to increased paper web strength. This process is characterized by the papermaking industry as "refining" and the machines for performing the process as refiners.

Although there are several design types of refiners available to the industry, the type to which the present invention is directed is the "plate" or "disc" refiner. The construction and operation of disc refiners is described more fully in U.S. Pat. Nos. 2,654,295 and 2,778,282 to L. M. Sutherland and U.S. Pat. No. 2,651,976 to D. M. Sutherland.

Generally, disc refiners comprise a pair of disc shaped grinding elements disposed for opposite hand relative rotation, usually about a common axis that is normal to the disc plane. The rotational planes of such discs are parallel with an adjustable space therebetween. Wood pulp stock flow is introduced as an aqueous slurry at the disc center and progresses through a fluid shear region between the disc faces toward the outer periphery thereof.

Prior art design of such refiner discs normally specifies a serrated surface comprising an alternating series of ridges and channels extending in generally radial directions. Such ridges are characterized as "bars."

Design modifications to the prior art specify parallelism of adjacent bars over a small arcuate section of the disc. Since a large fraction of the bars in a section will be of truncated length, large radial feed grooves are provided as stock conduits to the channels between the truncated bars. As a consequence of such flow patterns, however, all the stock delivered to a refiner is not subjected to equal mechanical treatment.

Ideally, each fiber should receive the same number of shear events which occur between passing bars respective to each disc. However, refining efficiency relates to the number of such shear events per relative revolution of a disc pair. Consequently, it is advantageous to provide as many bars and companion channels as the structural integrity of the disc material will permit. Normally, therefore, the bars may be as narrow as one eighth inch (0.32 cm) spaced by an equal width channel.

Another consideration is that due to the circular geometry of the flow region, the refining area of a disc pair increases by the square of the radius.

Collectively, therefore, a design compromise is forced between maximum refining efficiency for each annular increment of disc area and uniform mechanical treatment of each pulp fiber.

The prior art has promulgated numerous design solutions for the stated compromise. Those designs disclosed by the Sutherland patents, supra, are typical.

In a related art, that of grain grinding, a slightly different approach to disc design has been suggested. This approach generally comprises a curved, rather than straight line, path of the grain outward to the disc periphery. Such curved bar patterns are disclosed in U.S. Pat. Nos. 19,273; 27,551; 71,733; 120,505, 348,637; 499,714; 1,609,717; and 1,705,379. However, we are aware of only one instance, that disclosed by R. L. Reinhall in U.S. Pat. No. 3,674,217, in which a curved bar pattern has been suggested for use on wood pulp. Even in the case of Reinhall, the teaching is applied to defibration which is a gross separation of wood fiber bundles form a larger, chip particle, conglomerate. While the mechanical processes are outwardly similar, the comparison of defibration to refining is akin to that drawn between a blacksmith and a silversmith.

Nevertheless, the curved bar technique of disc design has been found to offer significant advantages in refiner efficiency and uniform stock treatment. However, due to the relative complexity of curved bar patterns, it would be questionable that such advantages outweigh the consequent cost burden.

It is, therefore, an object of this invention to teach a refiner plate design which provides uniform mechanical treatment to each fiber element passing therethrough.

Another object of the present invention is to teach a refiner disc bar pattern that is highly efficient in providing the maximum number of fiber impact events possible per corresponding radial increment.

Another object of the present invention is to teach a curved bar pattern for refiner discs that provides a uniform and continuous width flow channel between all bars from the inner ring groove to the outer, disc periphery.

Another object of the present invention is to teach a curved bar pattern for refiner discs that provides a substantially uniform bar thickness for all bars from the inner ring groove to the outer disc periphery.

Another object of the present invention is to teach a curved bar pattern having curved bar channels that may be conveniently machined with conventional machine tools on relatively simple jigs and fixtures.

SUMMARY OF THE INVENTION

The foregoing objectives of the present invention are served by a refiner disc wherein each channel between a respective pair of bars is developed as a circular arc having a center on a construction circle developed about the disc axis.

The center determination of each channel on the construction circle is derived from the point of intersection with a locus bisecting the angle developed about an adjacent channel center point between radii to the adjacent channel terminating at the inner ring groove and the outer disc periphery.

Determination of the construction circle radius is derived from the desired groove angle with the disc radius at the inner ring and outer disc periphery.

BRIEF DESCRIPTION OF THE DRAWING

Relative to the drawing wherein like reference characters designate like or similar elements in the several figures of the drawing.

DESCRIPTION FOR PREFERRED EMBODIMENT

The fiber working elements of disc refiners usually comprise two circular foundation elements aligned in face-to-face juxtaposition. These function elements may both be mounted for powered relative rotation, usually in opposite directions, or, only one may be rotatable with the other being a stationary portion of the machine frame or shroud.

Figure 1:
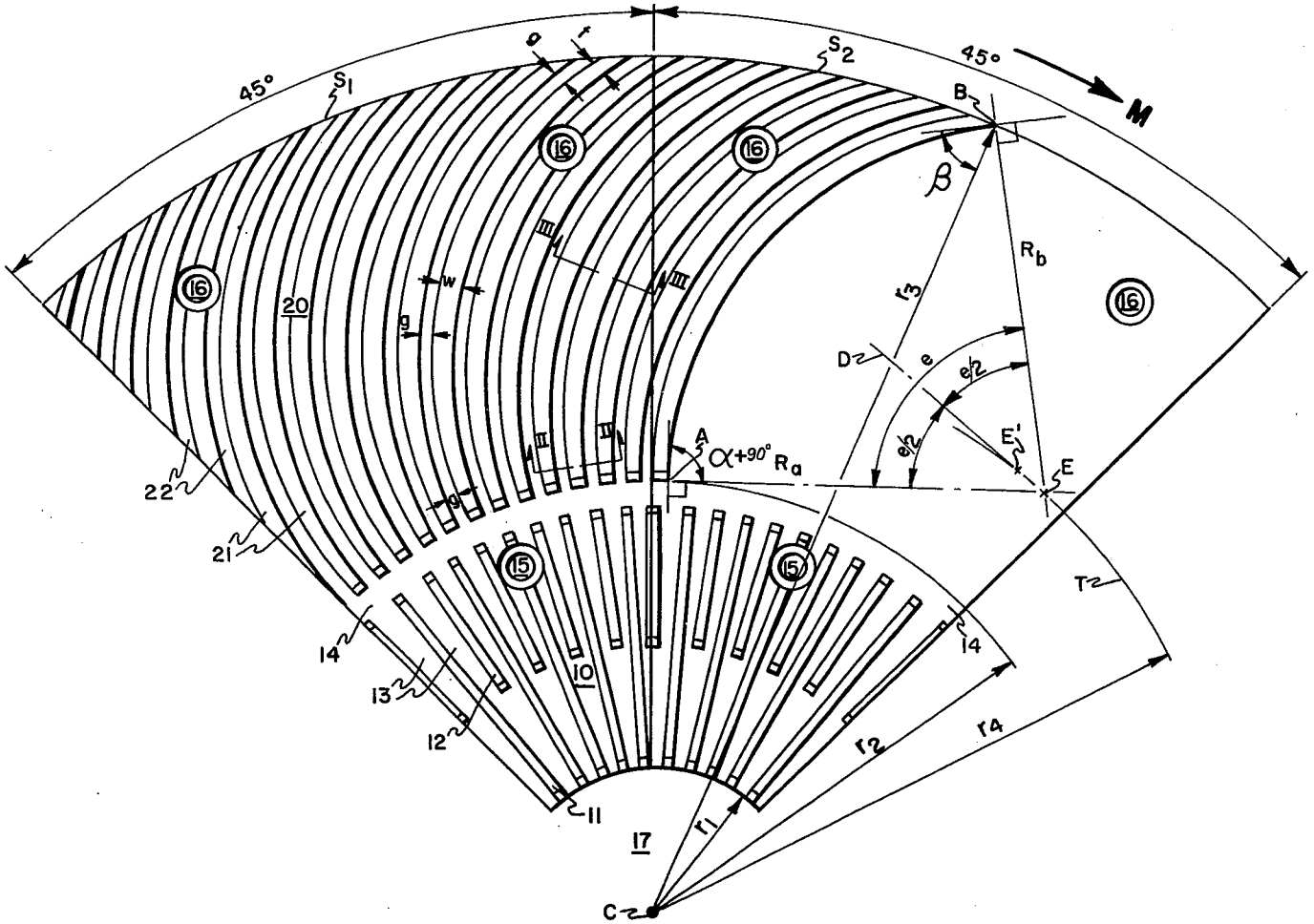
FIG. 1 is a view of the breaker bar face of two adjacent disc sectors constructed in accordance with the present invention.

In either case, it is the usual practice of the prior art to clad these disc foundation elements with expendable face discs that are divided radially into several circle sectors. For a standard size 44 inch (111.76 cm) refiner disc, the normal practice is to divide the face disc into 8, 45° arc circle sectors. Two such adjacent 45° circle sectors $S_1$ and $S_2$ are illustrated by FIG. 1.

Security of these sectors to respective foundation elements (not shown) is by means of machine screws inserted through counter bored bolt holes 15 and 16.

Near the circle center C, the sectors $S_1$ and $S_2$ are truncated along the periphery of radius $r_1$ to accommodate the pulp stock inflow area 17 about the rotational axis of the machine which coincides with center C.

The inner or, breaker section 10 of the sectors $S_1$ and $S_2$ extending between the stock inflow area 17 and the ring groove 14 is an annular section provided with beater bars 11 and 12 spaced by flow channels 13. These beater bars 11 and 12 are usually radial and, due to the closely convergent geometry of this section, are of differing length.

Since one functional purpose of the breaker section 10 is to break or shed large fiber bundles and trash that occasionally falls into the system, these breaker bars 11 and 12 are of greater width and lower height than the bars 21 of refining section 20.

Another, highly important functional purpose of the breaker section 10 is to uniformly distribute the incoming stock about the ring groove 14.

To the outer or refining section 20 of the disc, ring groove 14 functions as a stock distribution manifold for the refiner channels 22.

In most disc refiner designs, the actual fiber fibrillation is developed in the annular portion 20 encompassed by the outer radial half of the disc. It is to this portion of the disc and the design thereof that the present invention is directed.

Figure 2:
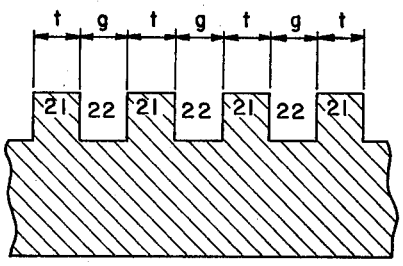
FIG. 2 is a sectional view of the bar and groove pattern of the invention from the perspective of cut-line II–II of FIG. 1.
Figure 3:
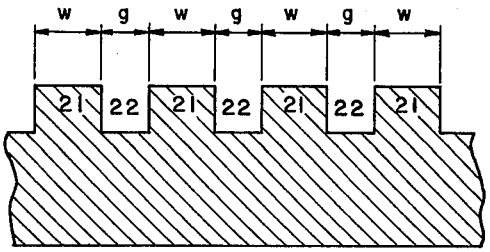
FIG. 3 is a sectional view of the bar and groove pattern of the invention from the perspective of cut-line III—III of FIG. 1.

As shown, the refiner section 20 of the disc comprises a series of alternating bars 21 and stock flow channels 22. Of the bars 21, it is to be noted that the width, $t$, (FIG. 2) at the ends thereof is slightly less than the width, $w$, (FIG. 3) at the center.

The channels 22 are usually of uniform depth and width, $g$, along the entire length thereof.

The aforedescribed configuration of the bars 21 and channels 22 in the disc refiner section 20 is derived from several interdependent design parameters.

The first of such design parameters is inner termination radius $r_2$ of the bars 21 which, in this example, coincides with the outer radius of the ring groove 14.

Another design parameter of consideration is the outer termination radius $r_3$ of the bars 21 which, in this example, coincides with the outer periphery of the disc.

The angle $\alpha$ is that which a channel 22 wall makes with a disc radius at the termination radius $r_2$. The angle $\alpha + 90°$ may be defined as that angle which the circular arc channel 22 radius $R_a$ makes with a disc radius passing through the point A whereat the wall of channel 22 intersects the $r_2$ periphery. If, as in the present example, the channel 22 wall is tangent to a disc radius at point A, the angle $\alpha$ is 0° and $\alpha + 90° = 90°$. Certain stock characteristics and flow conditions may suggest the desirability of an angle $\alpha$ other than 0°.

Angle $\beta$ is that which a channel 22 wall makes with a disc radius at the outer termination radius $r_3$. In the example, angle $\beta$ is given at 60° positive, relative to the disc rotational direction M. As in the angle $\alpha$, many circumstances may contribute to the selection of angle $\beta$ such as the flow pressure differential across the refiner. The positive angle illustrated is best suited for pressurized refining wherein the stock is pumped from the inlet area 17 across the disc face against a positive back pressure at the outer periphery.

A negative angle $\beta$ wherein the curve of the bars 21 and channels 22 sweep in the opposite direction relative to the rotation M is more suitable for open discharge refiners.

An empirical rule for maximum bar density is to provide equal width dimension for both, bars and channels. For most materials known to have property characteristics compatible with pulp stock refining application, one eighth inch (0.317 cm) represents a mimimum safe dimension for the width.

As previously described, the width of channels 22 is relatively constant throughout the length since this is the path of a constant diameter milling tool which is traced about the center E. The width of the bars 21 will vary from end to center, however, since opposite walls of a given bar will result from the trace of successive channel cuts about adjacent centers E and E'. Accordingly, some compromise of bar width as to center and ends will need to be reached. In this example the minimum, one eighth inch (0.317 cm) dimension was applied to the most narrow portion of the bar, at the ends thereof.

As will be better understood from the following development of the channel arc center E, the bar widths $t$ and $w$ are not independent parameters but are the combined result of the other factors.

Since the channel arc radii $R_a$ and $R_b$ are, definitively, normal to a channel tangent at the points A and B, respectively, and are equidistant in length, it follows that the intersection of locii conforming to these restrictions will be the center E. This analysis may be developed either analytically or graphically. Normally, a graphic solution will yield sufficiently accurate results.

The center E, being found by the foregoing development from radii $r_2$ and $r_3$ and angle $\alpha$ and $\beta$, the radial distance $r_4$ of the point E from the disc center c will define the radius of construction circle T. All channel 22 arcs are revolved about points E on this construction circle T.

Figure 4:
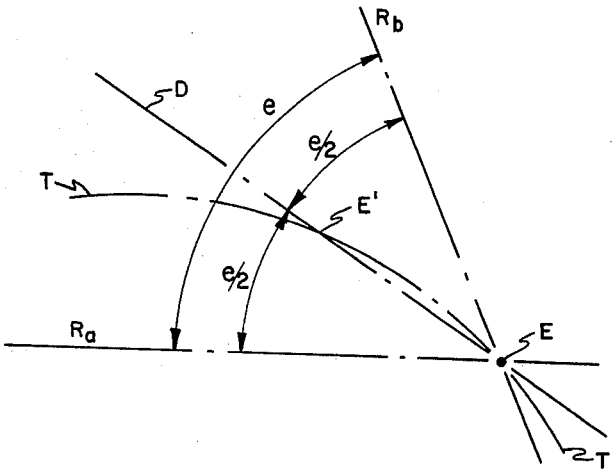
FIG. 4 is an enlarged representation of the construction circle development pursuant to the present invention.

As will be seen from FIGS. 1 and 4, the channel 22 arc radii $R_a$ and $R_b$ form an angle $e$ therebetween. The bisector D of this angle $e$ constitutes a chord of the construction circle T as best seen from FIG. 4 and therefore intersects the circle T at two points, E and E'.

The point E′ is therefore both, on the construction circle T and symmetrically displaced from point E relative to radii $R_a$ and $R_b$. Accordingly, each channel 22 having the same radius R will very nearly parallel the adjacent channels over the prescribed curvilinear arc; the error in such parallelism being resolved in the convergent thickness of the bars 21 from center to ends.

Those of ordinary skill in the art will appreciate an infinite number of parametric combinations available from the foregoing description. Since a 90° angle $\alpha$ is normally advisable for uniform stock distribution in most refiner applications, it would consequently follow that the construction circle T will lie within the refiner section annulus 20. However, at very low angles $\beta$, the channel radius R becomes very large and the included angle $e$ relatively small in which case the radius $r_4$ of construction circle T will exceed the outer disc radius $r_3$.

It will also be appreciated that since each channel 22 is cut by the single pass of a mill about a center E that may be located geometrically, jigs and fixtures may be devised for a particular machine tool to accurately locate each arc center E and traverse a relative rotation of the channel cutting tool thereabout.

Having described the preferred embodiment of my invention, I claim:

1. A pie segment of a fibrous stock refiner disc fabricated about an axis of revolution and having a serrated stock working face on one planar surface thereof, said face having a stock distribution groove segment of a circular ring developed about said axis and disposed radially between said axis and an outer peripherial boundary of said disc segment, serrations between said distribution groove and said outer boundary comprising an alternating series of curved bars and channels extending continuously from said groove to said outer boundary, each bar having substantially the same thickness at said groove as at said boundary and each channel being a substantially constant width arc of a first circle developed about a first center point located on the locus of a second circle, said second circle being developed about said axis of revolution.

2. A refiner disc segment as described by claim 1 wherein said center point of each channel is positioned at the intersection of said second circle locus and a bisector of the first circle arc corresponding to an adjacent channel.

3. A refiner disc segment as described by claim 2 wherein said second circle is radially disposed between said groove and said outer boundary.

4. A fibrous stock refining disc fabricated about an axis of revolution and having a stock refining face on one planar surface thereof, said face having a circular stock distribution groove developed about said axis and disposed radially between said axis and an outer peripherial boundary of said disc, said refining face comprising an alternating series of curved ridges and channels extending continuously from said groove to said outer boundary, each ridge having substantially the same thickness at said groove as at said boundary and each channel being a substantially constant width arc of a first circle developed about a first center point located on the locus of a second circle, said second circle being developed about said axis of revolution.

5. A refining disc as described by claim 4 wherein said center point of each channel is positioned at the intersection of said second circle locus and a bisector of said first circle arc corresponding to an adjacent channel.

6. A refining disc as described by claim 5 wherein said second circle is radially disposed between said groove and said outer boundary.

7. A refining disc as described by claim 4 wherein said disc is radially divided into a plurality of circle sectors.

8. A refining disc as described by claim 4 wherein a radius from said center point to an intersecting point of a corresponding channel arc with said groove is normal to a radius between said axis and said intersecting point of said corresponding channel arc with said groove.

* * * * *